US010997909B2

(12) United States Patent
Pyo et al.

(10) Patent No.: US 10,997,909 B2
(45) Date of Patent: May 4, 2021

(54) METHOD FOR SETTING BLACK DATA OF DISPLAY DEVICE AND DISPLAY DEVICE EMPLOYING THE SAME

(71) Applicant: Samsung Display Co., Ltd., Yongin-Si (KR)

(72) Inventors: Si Beak Pyo, Yongin-si (KR); Jun Ho Hwang, Yongin-si (KR); Jae Woo Song, Yongin-si (KR); Jong Kwang Hwang, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/044,188

(22) Filed: Jul. 24, 2018

(65) Prior Publication Data

US 2019/0130827 A1 May 2, 2019

(30) Foreign Application Priority Data

Oct. 31, 2017 (KR) ..... 10-2017-0143993

(51) Int. Cl.

| | |
|---|---|
| ***G09G 3/3233*** | (2016.01) |
| ***G09G 3/3258*** | (2016.01) |
| ***G09G 3/00*** | (2006.01) |
| ***G09G 3/3291*** | (2016.01) |
| ***G09G 3/20*** | (2006.01) |

(52) U.S. Cl.

CPC ..... *G09G 3/3233* (2013.01); *G09G 3/006* (2013.01); *G09G 3/2003* (2013.01); *G09G 3/3258* (2013.01); *G09G 3/3291* (2013.01); *G09G 2310/0256* (2013.01); *G09G 2320/0238* (2013.01); *G09G 2320/0242* (2013.01); *G09G 2320/0673* (2013.01); *G09G 2340/0435* (2013.01); *G09G 2360/145* (2013.01); *G09G 2360/16* (2013.01)

(58) Field of Classification Search

CPC ..... G09G 2310/0256; G09G 3/006; G09G 3/2003; G09G 3/3233; G09G 3/3258; G09G 3/3291; G09G 2360/145; G09G 2360/16; G09G 2340/0435; G09G 2320/0238; G09G 2320/0242; G09G 2320/0673

See application file for complete search history.

(56) References Cited

U.S. PATENT DOCUMENTS

| | | | |
|---|---|---|---|
| 9,013,519 | B2 | 4/2015 | Park et al. |
| 9,460,657 | B2 | 10/2016 | Pyo |
| 9,542,887 | B2 | 1/2017 | Pyo |
| 9,761,169 | B2 | 9/2017 | Park et al. |

(Continued)

FOREIGN PATENT DOCUMENTS

| | | | |
|---|---|---|---|
| CN | 106340267 | A | 1/2017 |
| KR | 10-2013-0086877 | A | 8/2013 |

(Continued)

*Primary Examiner* — Kwin Xie

(74) *Attorney, Agent, or Firm* — Innovation Counsel LLP

(57) ABSTRACT

There is provided a method for setting black data of a display device and a display device employing the same. In the method for setting black data of the display device including a display unit for displaying an image corresponding to data, the method includes: applying data having a test voltage to the display unit; measuring a luminance of a test image displayed in the display unit; and when the measured luminance is a reference luminance or less, setting first black data, based on the test voltage.

19 Claims, 6 Drawing Sheets

(56) References Cited

U.S. PATENT DOCUMENTS

| | | | | |
|---|---|---|---|---|
| 2005/0259092 | A1* | 11/2005 | Aoki | G09G 3/3648 345/204 |
| 2007/0057975 | A1* | 3/2007 | Oh | G09G 3/3648 345/690 |
| 2008/0111773 | A1* | 5/2008 | Tsuge | G09G 3/3241 345/76 |
| 2014/0125674 | A1* | 5/2014 | Wu | G09G 3/006 345/440 |
| 2015/0364089 | A1 | 12/2015 | Pyo et al. | |
| 2016/0165256 | A1* | 6/2016 | Van Der Vleuten | H04N 19/46 375/240.01 |
| 2016/0189676 | A1 | 6/2016 | Pyo | |
| 2016/0365025 | A1* | 12/2016 | Ding | G09G 3/006 |
| 2017/0011682 | A1 | 1/2017 | Pyo et al. | |
| 2017/0178553 | A1* | 6/2017 | Zhang | G09G 3/006 |

FOREIGN PATENT DOCUMENTS

| | | | |
|---|---|---|---|
| KR | 10-2014-0058283 | A | 5/2014 |
| KR | 10-1651291 | B1 | 8/2016 |
| KR | 10-2017-0066771 | A | 6/2017 |

* cited by examiner

METHOD FOR SETTING BLACK DATA OF DISPLAY DEVICE AND DISPLAY DEVICE EMPLOYING THE SAME

CROSS-REFERENCE TO RELATED APPLICATION

The present application claims priority under 35 U.S.C. § 119(a) to Korean patent application 10-2017-0143993 filed on Oct. 31, 2017 in the Korean Intellectual Property Office, the entire disclosure of which is incorporated herein by reference.

BACKGROUND

1. Technical Field

An aspect of the present disclosure relates to a method for setting black data of a display device and a display device employing the same.

2. Related Art

In general, the same black data is set in display devices manufactured by the same process, and black data is set based on a sample having the poorest characteristics and a driving condition of the sample.

When black data is set based on a sample having the poorest characteristics and a driving condition of the sample, the swing width between black data and white data is increased. Therefore, an afterimage of a previous image is displayed, or a color dragging phenomenon occurs.

SUMMARY

Embodiments provide a display device capable of displaying a high-quality image by decreasing the magnitude of a margin voltage applied when black data is set.

According to an aspect of the present disclosure, there is provided a method for setting black data of a display device including a display unit for displaying an image corresponding to data, the method including: applying data having a test voltage to the display unit; measuring a luminance of a test image displayed in the display unit; and when the measured luminance is a reference luminance or less, setting first black data, based on the test voltage.

The method may further include: when the measured luminance exceeds the reference luminance, changing the test voltage; and applying data having the changed test voltage to the display unit and re-measuring a luminance of a changed test image displayed in the display unit.

If the re-measured luminance is the reference luminance or less, the first black data may be set based on the changed test voltage. If the re-measured luminance exceeds the reference luminance, the changing of the test voltage, and the applying the data having the changed test voltage to the display unit and the re-measuring of the luminance of the changed test image displayed in the display unit may be repeated.

The first black data may be set by adding a first margin voltage to the test voltage.

The first black data may be used when the display device is driven at a first driving frequency.

The method may further include setting second black data used when the display device is driven at a second driving frequency higher than the first driving frequency, with reference to the first black data.

The second black data may be set by removing a preset voltage from the first black data.

The method may further include setting black data respectively corresponding to reference luminance points set based on a target luminance of light to be emitted by the display device.

According to an aspect of the present disclosure, there is provided a display device including: a display unit configured to display an image, based on data; a data driver configured to supply the data to the display unit; and a black data setting unit configured to set first black data, based on a luminance of a test image, the test image being displayed based on data having a test voltage that is supplied to the display unit.

When the luminance of the test image is a reference luminance or less, the black data setting unit may set the first black data, based on the test voltage.

The first black data may be set by adding a first margin voltage to the test voltage.

The display device may be configured to be driven at a first driving frequency or be configured to be driven at a second driving frequency higher than the first driving frequency.

The first black data may be used when the display device is driven at the first driving frequency.

The black data setting unit may be configured to set second black data used when the display device is driven at the second driving frequency, based on the first black data.

The second black data may be set by removing a preset voltage from the first black data.

The black data setting unit may be configured to set black data respectively corresponding to reference luminance points set based on a target luminance of light to be emitted by the display unit.

The black data may be set by applying preset offset values to the first black data to correspond to the respective reference luminance points.

The reference luminance points may include a first reference luminance point and a second reference luminance point smaller that the first reference luminance point. Black data corresponding to the first reference luminance point may be larger than that corresponding to the second reference luminance point.

The display device may further include a gamma voltage generating unit configured to transfer a gamma voltage to the data driver. The gamma voltage generating unit may be configured to generate a first gamma voltage corresponding to the first black data.

The gamma voltage generating unit may be configured to generate a second gamma voltage corresponding to the second black data.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
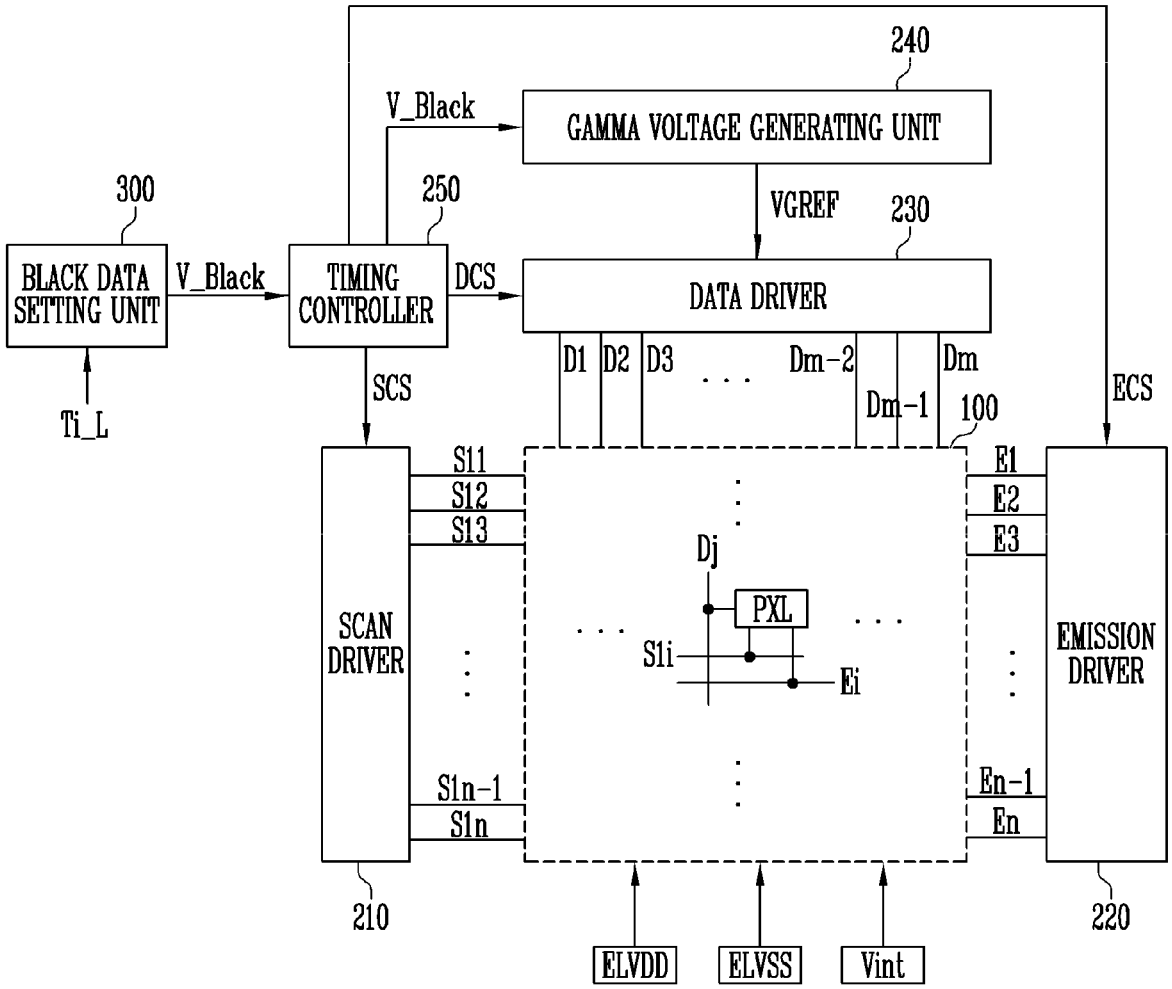
FIG. 1 is a diagram schematically illustrating a configuration of a display device according to an embodiment of the present disclosure.

The features of the inventive concept, and the way of attaining them, will become apparent with reference to embodiments described below in conjunction with the accompanying drawings. However, the present disclosure is not limited to the embodiments but may be implemented into different forms. These embodiments are provided only for illustrative purposes and for full understanding of the scope of the present disclosure by those skilled in the art. In the entire specification, when an element is referred to as being "connected" or "coupled" to another element, it can be directly connected or coupled to the another element or be indirectly connected or coupled to the another element with one or more intervening elements interposed therebetween. It should note that in giving reference numerals to elements of each drawing, like reference numerals refer to like elements even though like elements are shown in different drawings.

Hereinafter, a method for setting black data of a display device and a display device employing the same will be described with reference to exemplary embodiments in conjunction with the accompanying drawings.

FIG. 1 is a diagram schematically illustrating a configuration of a display device according to an embodiment of the present disclosure.

Referring to FIG. 1, the display device according to the embodiment of the present disclosure may include a display unit 100, a scan driver 210, an emission driver 220, a data driver 230, a gamma voltage generating unit 240, a timing controller 250, and a black data setting unit 300.

The black data setting unit 300 may set black data suitable for the display device, and supply information on the set black data to the timing controller 250.

The black data setting unit 300, as shown in FIG. 1, may be disposed at a front end of the timing controller 250. In this case, the black data setting unit 300 may be included in a host system (not shown) that generates a plurality of clock signals, etc. and outputs the generated signals to the timing controller 250. However, the present disclosure is not limited thereto, and the black data setting unit 300 may be formed as a component separate from the host system.

Alternatively, the black data setting unit 300 may be disposed between the timing controller 250 and the data driver 230, or be included in the timing controller 250.

The timing controller 250 may generate a scan driving control signal SCS, a data driving control signal DCS, and an emission driving control signal ECS, based on signals input from the outside. The scan driving control signal SCS generated by the timing controller 250 is supplied to the scan driver 210, the data driving control signal DCS generated by the timing controller 250 is supplied to the data driver 230, and the emission driving control signal ECS generated by the timing controller 250 is supplied to the emission driver 220.

The scan driver 210 may supply a scan signal to scan lines S11 to S1*n*, in response to the scan driving control signal SCS. For example, the scan driver 210 may sequentially supply the scan signal to the scan lines S11 to S1*n*.

If the scan signal is sequentially supplied to the scan lines S11 to S1*n*, pixels PXL may be selected in units of horizontal lines. To this end, the scan signal may be set to a gate-on voltage (e.g., a low-level voltage) such that transistors included in the pixels PXL can be turned on.

The data driver 230 may supply a data signal to data lines D1 to Dm in response to the data driving control signal DCS. The data signal supplied to the data lines D1 to Dm may be supplied to pixels PXL selected by the scan signal.

The emission driver 220 may supply an emission control signal to emission control lines E1 to En in response to the emission driving control signal ECS. For example, the emission driver 220 may sequentially supply the emission control signal to the emission control lines E1 to En.

If the emission control signal is sequentially supplied to the emission control lines E1 to En, light may not be emitted from the pixels PXL in units of horizontal lines. To this end, the emission control signal may be set to a gate-off voltage (e.g., a high-level voltage) such that the transistors included in the pixels PXL can be turned off.

Meanwhile, in FIG. 1, it is illustrated that the scan driver 210 and the emission driver 220 are components separate from each other, but the present disclosure is not limited thereto. For example, the scan driver 210 and the emission driver 220 may be formed as one driver.

In addition, the scan driver 210 and/or the emission driver 220 may be mounted on a substrate through a thin film process.

Also, the scan driver 210 and/or the emission driver 220 may be located at both sides of the display unit 100 with the display unit 100 interposed therebetween.

The gamma voltage generating unit 240 may generate a gamma voltage VGREF, based on the black data set by the black data setting unit 300. To this end, the gamma voltage generating unit 240 may receive black data V_Black from the outside.

In FIG. 1, it is illustrated that the gamma voltage generating unit 240 receives the black data V_Black from the timing controller 250. However, the present disclosure is not limited thereto, and the gamma voltage generating unit 240 may receive the black data V_Black from the black data setting unit 300.

In order to generate the gamma voltage VGREF corresponding to the set black data V_Black, a separate logic may be provided in the gamma voltage generating unit 240. For example, the logic may be a function, a code, or the like, which can change a gamma voltage that becomes a reference according to the set black data V_Black.

The gamma voltage generating unit 240 may transfer the generated gamma voltage VGREF to the data driver 230.

The display unit 100 may include the plurality of pixels PXL coupled to the data lines D1 to Dm, the scan lines S11 to S1*n*, and the emission control lines E1 to En.

The pixels PXL may be supplied with an initialization power source Vint, a first power source ELVDD, and a second power source ELVSS.

Each of the pixels PXL may be selected when a scan signal is supplied to a scan line S11 to S1*n* coupled thereto to be supplied with a data signal. The pixel PXL supplied with the data signal may control an amount of current flowing from the first power source ELVDD to the second power source ELVSS via an organic light emitting diode (not shown), corresponding to the data signal.

At this time, the organic light emitting diode may generate light with a predetermined luminance, corresponding to the amount of current. Additionally, the first power source ELVDD may be set to a voltage higher than that of the second power source ELVSS.

The black data is used to display a black image. If black data is supplied to the display unit 100, a black image may be displayed through the display unit 100.

Meanwhile, in FIG. 1, it is illustrated that the pixel PXL is coupled to one scan line S1*i*, one data line Dj, and one emission control line Ei, but the present disclosure is not limited thereto. In other words, the number of scan lines S11 to S1*n* coupled to the pixel, corresponding to the circuit structure of the pixel PXL may be plural, and the number of emission control lines E1 to En coupled to the pixel, corresponding to the circuit structure of the pixel PXL may be plural.

In some cases, the pixel PXL may be coupled to only the scan lines S11 to S1*n* and the data line D1 to Dm. In this case, the emission control lines E1 to En and the emission driver 220 for driving the emission control lines E1 to En may be removed.

Figure 2:
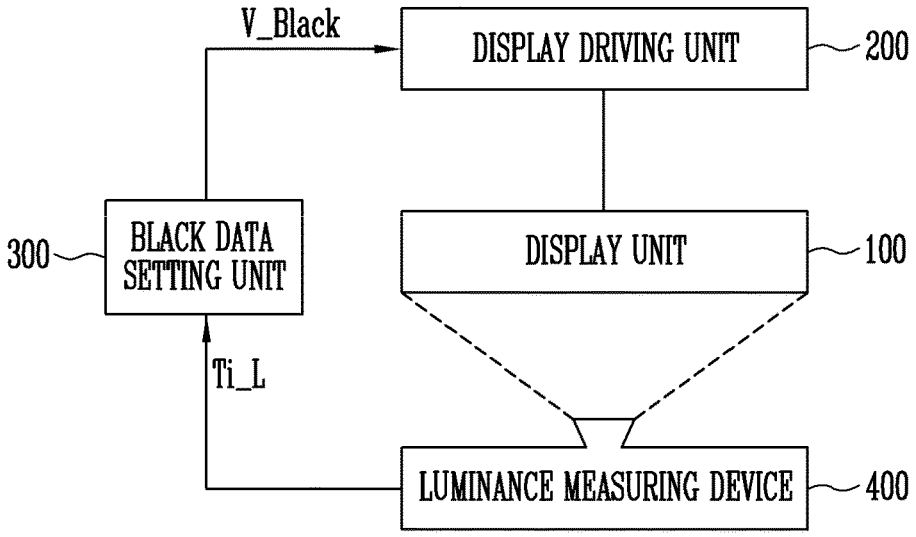
FIG. 2 is a diagram schematically illustrating a configuration of a system for setting black data of the display device.

FIG. 2 is a diagram schematically illustrating a configuration of a system for setting black data of the display device.

Referring to FIGS. 1 and 2, the system for setting black data of the display device may include the display unit 100, a display driving unit 200, the black data setting unit 300, and a luminance measuring device 400.

Here, the display unit 100, the display driving unit 200, and the black data setting unit 300 may constitute the display device shown in FIG. 1. In addition, the display driving unit 200 may include the scan driver 210, the emission driver 220, the data driver 230, the gamma voltage generating unit 240, and the timing controller 250, which are shown in FIG. 1.

When a test image is displayed as data having a test voltage is applied to the display unit 100, the luminance measuring device 400 may measure a luminance of the test image.

The black data setting unit 300 may be coupled to the luminance measuring device 400, to acquire a luminance Ti_L of the test image from the luminance measuring device 400. For example, the black data setting unit 300 may be temporarily coupled to the luminance measuring device 400 during manufacturing of the display device, or be temporarily coupled to the luminance measuring device 400 after the manufacturing of the display device is completed.

If the black data of the display device is set, the display device may be separated from the luminance measuring device 400.

Figure 3:
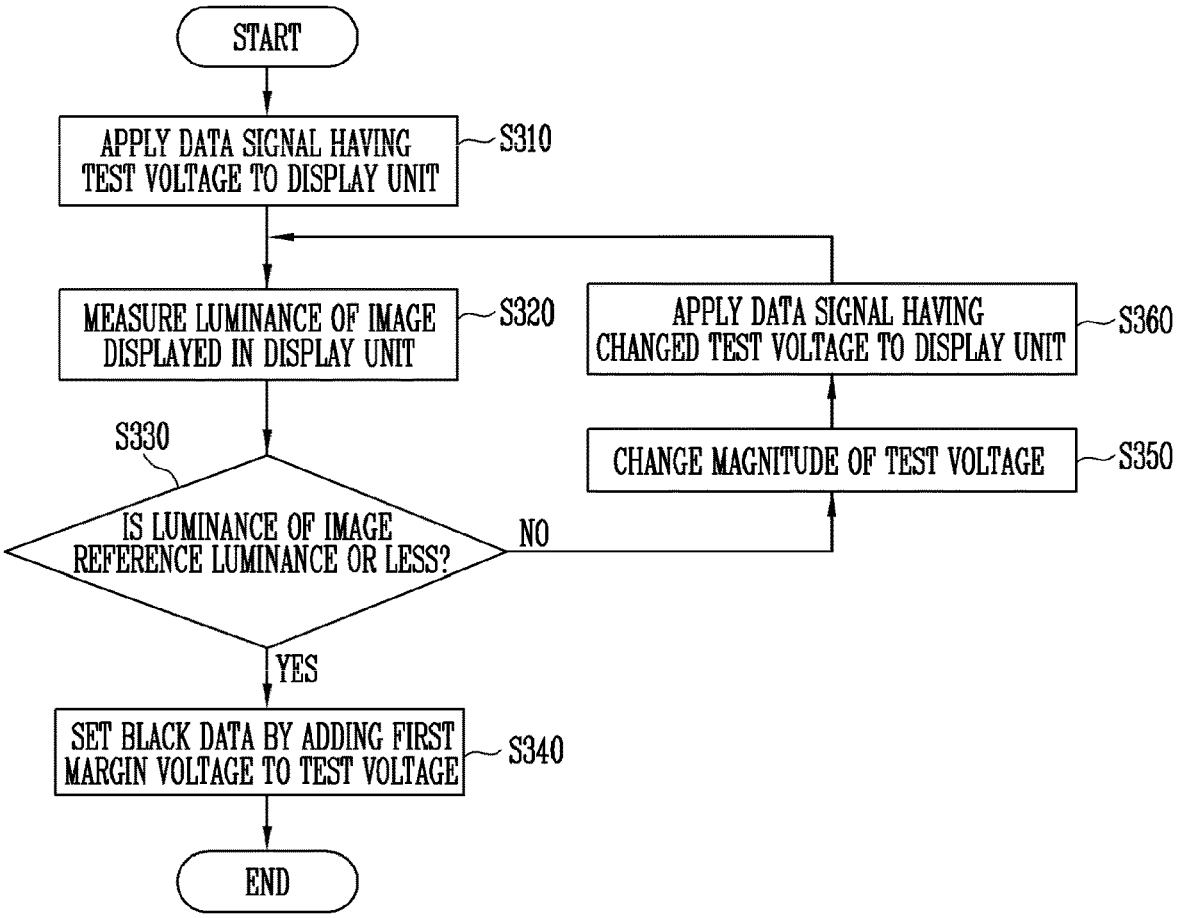
FIG. 3 is a flowchart illustrating a method for setting black data of the display device according to an embodiment of the present disclosure.

FIG. 3 is a flowchart illustrating a method for setting black data of the display device according to an embodiment of the present disclosure.

Referring to FIGS. 1 to 3, in order to set black data suitable for the display device, data having a test voltage may be applied to the display unit 100 (operation S310). The test voltage may be a voltage set by considering that the test voltage is used to display a black image. The data having the test voltage may be data output from the black data setting unit 300, but the present disclosure is not limited thereto.

If the data having the test voltage is applied to the display unit 100, a test image is displayed in the display unit 100. The luminance measuring device 400 may measure a luminance of the test image that is an image displayed in the display unit 100 (operation S320).

The black data setting unit 300 may acquire the luminance Ti_L of the test image from the luminance measuring device 400. The black data setting unit 300 may determine whether the luminance Ti_L of the test image is a reference luminance or less (operation S330).

When the luminance Ti_L of the test image is the reference luminance or less, the black data setting unit 300 may set black data with reference to the data having the test voltage. For example, the black data may be set by adding a first margin voltage to the test voltage (operation S340).

When the luminance Ti_L of the test image exceeds the reference luminance, the black data setting unit 300 may change the magnitude of the test voltage (operation S350). For example, the magnitude of the test voltage may be increased by a predetermined value.

Meanwhile, in this specification, it is described that the magnitude of the test voltage is increased in the operation S350, but the present disclosure is not limited thereto. For example, in the case of a display device in which the luminance of an image becomes lower as the size of data becomes smaller, the magnitude of the test voltage may be decreased by the predetermined value in the operation S350.

After the operation S350, data having a changed test voltage may be applied to the display unit 100 (operation S360).

If the data having the changed test voltage is applied to the display unit 100, the display unit 100 may display a test image corresponding to the changed test voltage. The luminance measuring device 400 may measure a luminance Ti_L of the test image displayed in the display unit 100 (operation S320). At this time, if the luminance Ti_L of the test image is the reference luminance or less, black data may be set according to the operation S340. If the luminance Ti_L of the test image exceeds the reference luminance, the operations S350, S360, S320, and S330 may be repeated until the luminance Ti_L of the test image becomes the reference luminance or less.

Hereinafter, an operation of setting black data of an arbitrary cell according to the method shown in FIG. 3 will be exemplarily described with reference to FIGS. 4 and 5. Here, the cell may be any one arbitrarily selected among a plurality of display devices manufactured through the same process.

A case where the minimum value of the test voltage is set to 5.9 V, the reference luminance for determining whether black data has been set is set to 0.005 nit, and the first margin voltage is set to 0.2 V is described as an example.

Referring to FIGS. 1 to 5, first, after data having a test voltage of 5.9 V is applied to a display unit of the arbitrary cell, a luminance Ti_L of a test image displayed in the display unit may be measured.

Figure 4:
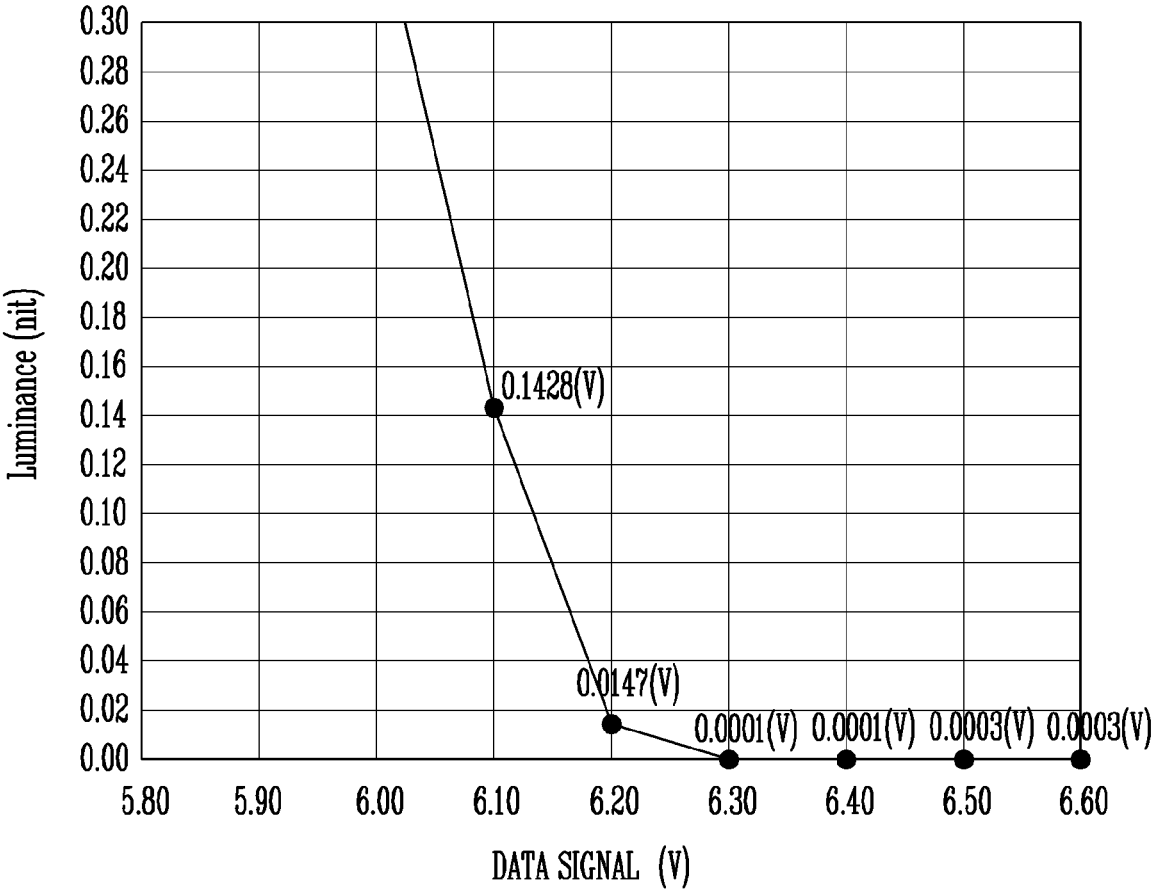
FIGS. 4 and 5 are diagrams exemplarily illustrating an operation of setting black data according to the method shown in FIG. 3.

FIG. 4 is a graph illustrating changes in luminance of an image, based on changes in data.

Referring to FIG. 4, since the luminance of an image corresponding to the data having the test voltage of 5.9 V is greater than 0.005 nit, the test voltage is increased to 6.0 V.

However, unlike the arbitrary cell, in the case of a cell in which the luminance of an image corresponding to the data having the test voltage of 5.9 V is 0.005 nit or less, the black data V_Black may be set by adding a first margin voltage V_ml of 0.2 V to the test voltage of 5.9 V.

Next, after data having a test voltage of 6.0 V is applied, a luminance Ti_L of a test image displayed in the display unit of the arbitrary cell may be measured.

Referring to FIG. 4, since the luminance of an image corresponding to the data having the test voltage of 6.0 V is greater than 0.005 nit, the test voltage is increased to 6.1 V.

However, unlike the arbitrary cell, in the case of a cell in which the luminance of an image corresponding to the data having the test voltage of 6.0 V is 0.005 nit or less, the black data V_Black may be set by adding the first margin voltage V_ml of 0.2 V to the test voltage of 6.0 V.

Next, after data having a test voltage of 6.1 V is applied, a luminance Ti_L of a test image displayed in the display unit of the arbitrary cell may be measured.

Referring to FIG. 4, since the luminance of an image corresponding to the data having the test voltage of 6.1 V is 0.1428 nit, the test voltage is increased to 6.2 V.

However, unlike the arbitrary cell, in the case of a cell in which the luminance of an image corresponding to the data having the test voltage of 6.1 V is 0.005 nit or less, the black data V_Black may be set by adding the first margin voltage V_ml of 0.2 V to the test voltage of 6.1 V.

Next, after data having a test voltage of 6.2 V is applied, a luminance Ti_L of a test image displayed in the display unit of the arbitrary cell may be measured.

Referring to FIG. 4, since the luminance of an image corresponding to the data having the test voltage of 6.2 V is 0.0147 nit, the test voltage is increased to 6.3 V.

However, unlike the arbitrary cell, in the case of a cell in which the luminance of an image corresponding to the data having the test voltage of 6.2 V is 0.005 nit or less, the black data V_Black may be set by adding the first margin voltage V_ml of 0.2 V to the test voltage of 6.2 V.

Next, after data having a test voltage of 6.3 V is applied, a luminance Ti_L of a test image displayed in the display unit of the arbitrary cell may be measured.

Referring to FIG. 4, since the luminance of an image corresponding to the data having the test voltage of 6.3 V is 0.0001 nit that is smaller than 0.005 nit, the black data V_Black may be set by adding the first margin voltage V_ml of 0.2 V to the test voltage of 6.3 V.

Meanwhile, a case where the operations S350, S360, S320, and S330 are repeated until the luminance Ti_L of the test image becomes the reference luminance or less is described in FIG. 3, but the present disclosure is not limited thereto. For example, if the condition according to the operation S330 is not satisfied even when the test voltage is increased to a preset reference, black data may be set with reference to the preset reference.

Figure 5:
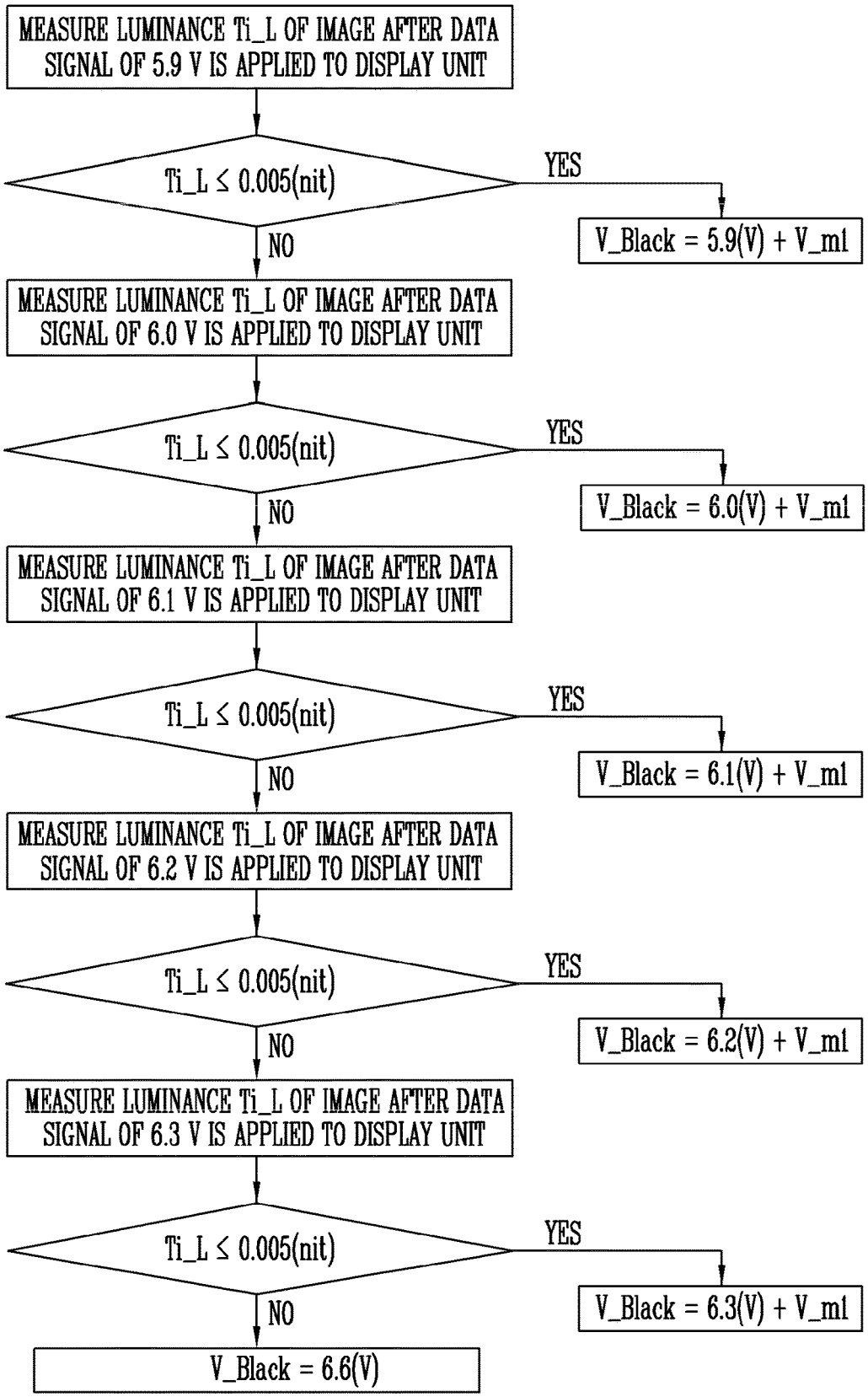

That is, as shown in FIG. 5, in the case of a cell in which the luminance of an image corresponding to the data having the test voltage of 6.3 V exceeds 0.005 nit, the black data V_black may be set by allowing the test voltage to be increased to 6.4 V and adding the first margin voltage V_ml of 0.2 V to the test voltage of 6.4 V. In other words, the operations S350, S360, S320, and S330 of FIG. 3 may be repeated only until the test voltage reaches a preset maximum test voltage (e.g., 6.3 V).

In the related art, in display devices manufacture through the same manufacturing process, black data was set by considering a cell having the poorest characteristics and a driving condition of the cell, and the set black data was uniformly applied to all of the display devices in a lump. Accordingly, the black data was set to an unnecessarily large value. Therefore, an afterimage of a previous image was displayed, or a color dragging phenomenon occurred.

However, according to the embodiment of the present disclosure, black data suitable for each display device is individually searched and set, so that it is possible to solve the problem according to the related art.

Hereinafter, the reason why the first margin voltage is added when the black data is set will be described in detail with reference to FIGS. 6A and 6B.

Figure 6A:
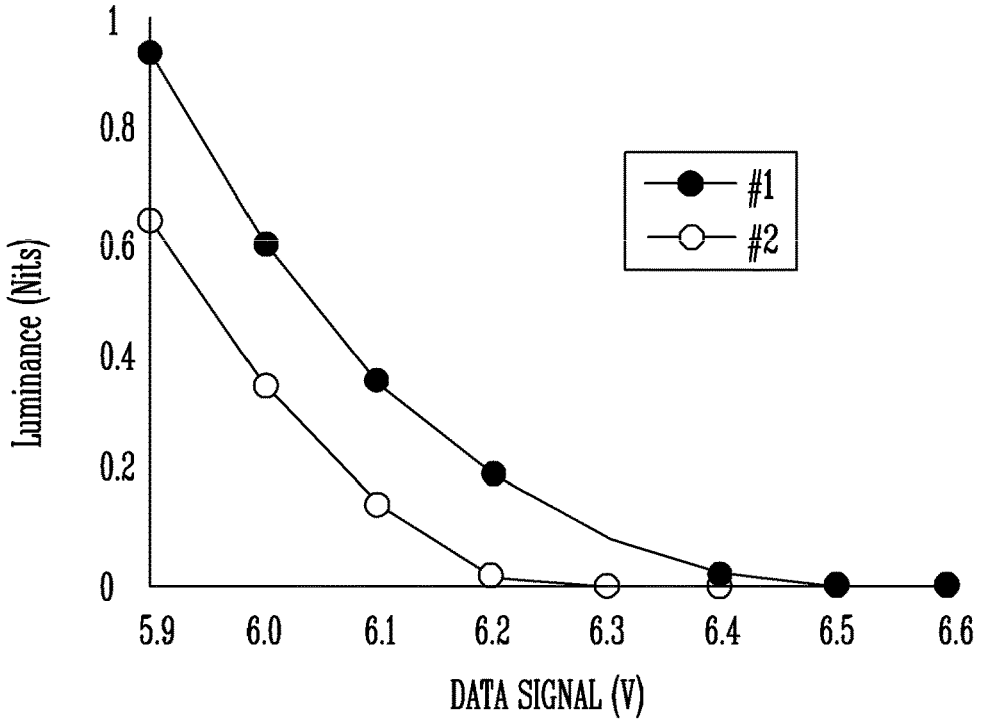
FIGS. 6A and 6B are diagrams illustrating a reference for setting a first margin voltage according to an embodiment of the present disclosure.
Figure 6B:
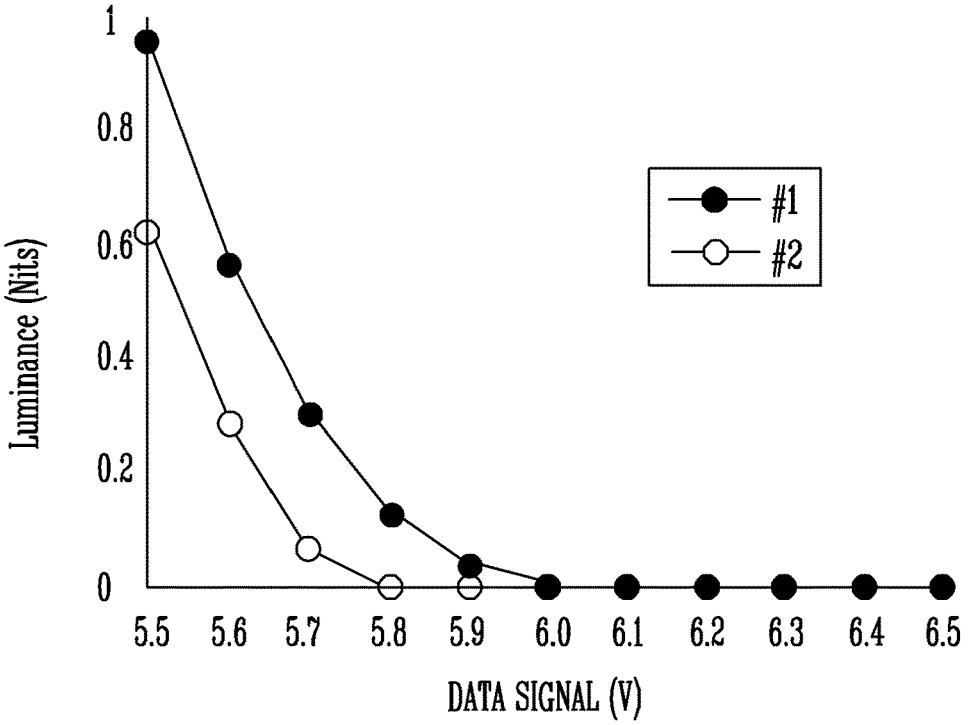

FIGS. 6A and 6B are diagrams illustrating a reference for setting the first margin voltage according to an embodiment of the present disclosure.

FIG. 6A is a diagram illustrating changes in luminance of an image corresponding to changes in data, which are measured in a first cell, and FIG. 6B is a diagram illustrating changes in luminance of an image corresponding to changes in data, which are measured in a second cell. Here, the cell may be any one arbitrarily selected from a plurality of display devices manufactured through the same process.

In FIG. 6A, graph #1 illustrates changes in luminance of an image corresponding to changes in data when the second power source ELVSS supplied to the display unit 100 of the first cell is set to −4.9 V, and graph #2 illustrates changes in luminance of an image corresponding to changes in data when the second power source ELVSS supplied to the display unit 100 of the first cell is set to −3.7 V.

Also, in FIG. 6B, graph #1 illustrates changes in luminance of an image corresponding to changes in data when the second power source ELVSS supplied to the display unit 100 of the second cell is set to −4.9 V, and graph #2 illustrates changes in luminance of an image corresponding to changes in data when the second power source ELVSS supplied to the display unit 100 of the second cell is set to −3.5 V.

Referring to FIG. 6A, if data of 6.3 V is to be applied so as to display a black image when the second power source ELVSS is −3.7 V, data of 6.5 V is to be applied so as to display the black image when the second power source ELVSS is −4.9 V. That is, when the second power source ELVSS is −4.9 V, the black image may not be expressed using the data of 6.3 V.

Also, referring to FIG. 6B, if data of 5.8 V is to be applied so as to display a black image when the second power source ELVSS is −3.5 V, data of 6.0 V is to be applied so as to display the black image when the second power source ELVSS is −4.9 V. That is, when the second power source ELVSS is −4.9 V, the black image may not be expressed using the data of 5.8 V.

Temperature in an ambient environment of the display device may have great influence on the second power source ELVSS. For example, if the ambient temperature of the display device is decreased by 20° C., the second power source ELVSS actually supplied to the display unit 100 may be shifted by a maximum of −1.5 V.

That is, in consideration that the second power source ELVSS will be decreased as the display device is used at a low temperature, the black data may be set by adding the first margin voltage to the test voltage described with reference to FIGS. 1 to 5.

Hereinafter, a method for setting black data in a display device of which driving frequency is changeable will be described in detail with further reference to FIG. 7.

The display device shown in FIG. 1 may be driven in a first mode in which the display device is driven at a first driving frequency (e.g., 60 Hz) or a second mode in which the display device is driven at a second driving frequency (e.g., 75 Hz) higher than the first driving frequency. Here, that the display device is driven at the first driving frequency may mean that the display device is driven such that one frame is displayed for 1/60 second, and that the display device is driven at the second driving frequency may mean that the display device is driven such that one frame is displayed for 1/75 second.

In general, when the display device is mounted in a wearable device or the like to display a stereoscopic image or the like, the display device is driven in the second mode. At this time, the time for which the organic light emitting diode included in each of the pixels emits light in the second mode is set shorter than that for which the organic light emitting diode included in each of the pixels emits light in the first mode.

As the time for which the organic light emitting diode emits light becomes shorter, the minimum value of data capable of expressing a black image becomes smaller. The following Table 1 illustrates results obtained by measuring the minimum value VB1 of data capable of expressing the black image when the display device is driven at 60 Hz and the minimum value VB2 of data capable of expressing the black image when the display device is driven at 75 Hz.

TABLE 1

| Classification | VB1 (V) | VB2 (V) |
|---|---|---|
| First cell | 5.6 | 5.3 |
| Second cell | 5.7 | 5.3 |
| Third cell | 5.7 | 5.3 |
| Fourth cell | 5.8 | 5.4 |
| Fifth cell | 5.8 | 5.4 |

Referring to Table 1, it can be seen that the minimum value of data capable of expressing the black image is changed for each driving frequency.

Therefore, when black data of the display device that is driven at the first driving frequency or the second driving frequency is set, it is to be considered that the driving frequency of the display device will be changed.

Figure 7:
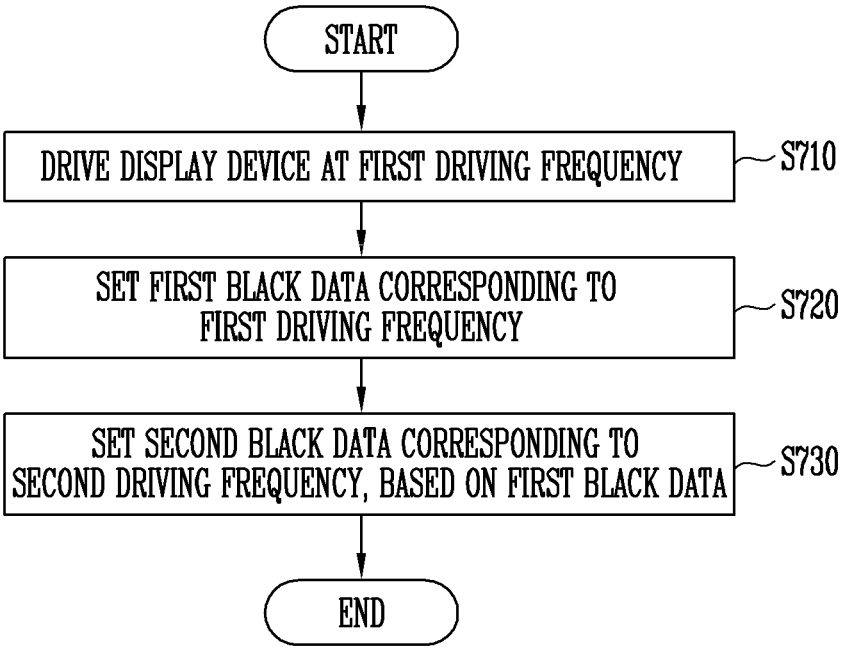
FIGS. 7 and 8 are flowcharts illustrating a method for setting black data of the display device according to another embodiment of the present disclosure.

Referring to FIG. 7, first, the display device may be driven at the first driving frequency to set black data applied when the display device is driven at the first driving frequency (operation S710).

After the operation S710, first black data corresponding to the first driving frequency may be set (operation S720). Here, a method for setting the first black data may be the same as the method for setting black data, which described with reference to FIGS. 1 to 5.

Second black data corresponding to the second driving frequency may be set based on the first black data set in the operation S720 (operation S730).

As described with reference to Table 1, since the minimum value of data capable of expressing the black image when the display device is driven at the second driving frequency is smaller than that of data capable of expressing the black image when the display device is driven at the first driving frequency, a value obtained by removing a preset second margin voltage from the first black data may be set to the second black data. For example, the second margin voltage may be set to 0.2 V. However, the present disclosure is not limited thereto, and the second margin voltage may be variously changed and set.

As described above, when the display device is driven at the first driving frequency or the second driving frequency, the gamma voltage generating unit 240 may generate a first gamma voltage, based on the first black data, and generate a second gamma voltage, based on the second black data.

Hereinafter, a method for setting black data of the display device according to another embodiment of the present disclosure will be described in detail.

The luminance of the display device according to the embodiment of the present disclosure may be divided into a plurality of reference luminance levels DBL. For example, as shown in the following Table 2, the reference luminance may be divided into 11 levels when the display device is driven at the first driving frequency, and be divided into 4 levels when the display device is driven at the second driving frequency.

TABLE 2

| Driving frequency | DBL | DBV | V_Black |
|---|---|---|---|
| 60 Hz | LEVEL1 | DBV1 = 750 (nit) | V_Black1 |
| | LEVEL2 | DBV2 = 650 (nit) | V_Black2 = V_Black1 + offset1 |
| | LEVEL3 | DBV3 = 300 (nit) | V_Black3 = V_Black1 + offset2 |
| | LEVEL4 | DBV4 = 100 (nit) | V_Black4 = V_Black1 + offset3 |
| | LEVEL5 | DBV5 = 60 (nit) | V_Black5 = V_Black1 + offset4 |
| | LEVEL6 | DBV6 = 30 (nit) | V_Black6 = V_Black1 + offset5 |
| | LEVEL7 | DBV7 = 15 (nit) | V_Black7 = V_Black1 + offset6 |
| | LEVEL8 | DBV8 = 10 (nit) | V_Black8 = V_Black1 + offset7 |
| | LEVEL9 | DBV9 = 7 (nit) | V_Black9 = V_Black1 + offset8 |
| | LEVEL10 | DBV10 = 4 (nit) | V_Black10 = V_Black1 + offset9 |
| | LEVEL11 | DBV11 = 2 (nit) | V_Black11 = V_Black1 + offset10 |
| 75 Hz | LEVEL1 | DBV1' = 100 (nit) | V_Black12 = V_Black1 + offset11 |
| | LEVEL2 | DBV2' = 60 (nit) | V_Black13 = V_Black1 + offset12 |
| | LEVEL3 | DBV3' = 45 (nit) | V_Black14 = V_Black1 + offset13 |
| | LEVEL4 | DBV4' = 30 (nit) | V_Black15 = V_Black1 + offset14 |

Referring to Table 2, when the display device is driven at the first driving frequency, a first level LEVEL1 among the reference luminance levels DBL may be set to the maximum luminance level, and an eleventh level LEVEL11 among the reference luminance levels DBL may be set to the minimum luminance level. First to eleventh levels may be defined by first reference luminance points DB1 to DBV11, respectively.

Also, referring to Table 2, when the display device is driven at the second driving frequency, a first level LEVEL1 among the reference luminance levels DBL may be set to the maximum luminance level, and a fourth level LEVEL4 among the reference luminance levels DBL may be set to the minimum luminance level. First to fourth levels may be defined by second reference luminance points DBV1' to DBV4', respectively.

As the value of the reference luminance point becomes smaller, the time for which the organic light emitting diode emits light may become shorter. Therefore, black data may be differently set for the respective reference luminance levels.

Specifically, the black data setting unit 300 according to the embodiment of the present disclosure may set black data V_Black1 to V_Black15 respectively corresponding to the reference luminance points DBV1 to DBV11 and DBV1' to DBV4'.

Figure 8:
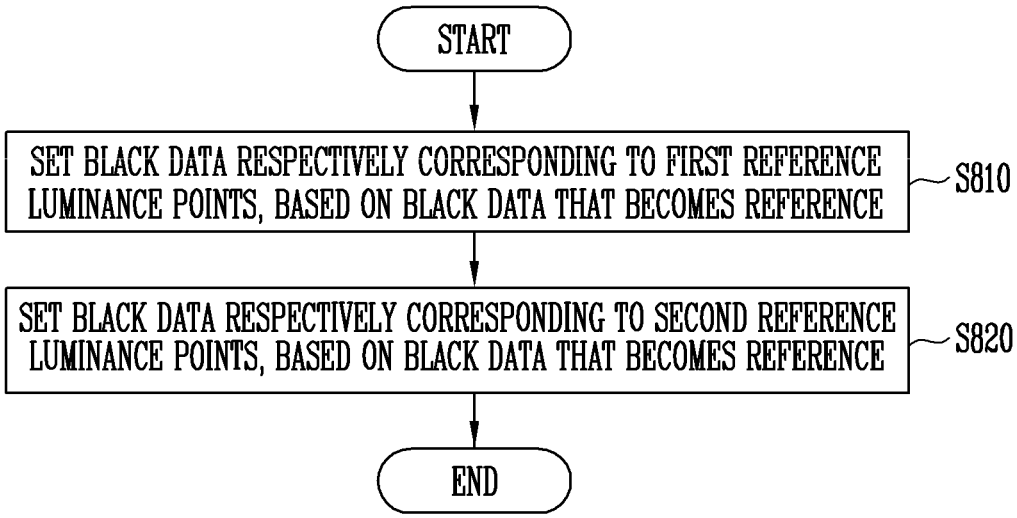

Referring to FIG. 8, first, black data respectively corresponding to the first reference luminance points DBV1 to DBV11 may be set based on black data that becomes a reference (operation S810).

Specifically, the black data that becomes the reference may be set as black data V_Black1 corresponding to a first reference luminance point DBV1. Here, the black data V_Black1 that becomes the reference may be black data set by the method for setting black data, which is described with reference to FIGS. 1 to 5.

Referring to Table 2, black data V_Black2 to V_Black11 respectively corresponding to the other first reference luminance points DBV2 to DBV11 may be set by applying preset offset values offset1 to offset10 to the black data V_Black1 that becomes the reference.

Here, the offset values offset1 to offset10 may have negative values. Also, the offset values offset1 to offset10 may have the same value or have values different from one another. In addition, the absolute value of a tenth offset value offset10 may be larger than that of a first offset value offset1.

After the operation S810, black data respectively corresponding to the second reference luminance points DBV1' to DBV4' may be set based on the black data that becomes the reference (operation 820).

Referring to Table 2, black data V_Black12 to V_Black15 respectively corresponding to the second reference luminance points DBV1' to DBV4' may be set by applying preset offset values offset11 to offset14 to the black data V_Black1 corresponding to the first reference luminance point DBV1 of the first LEVEL1.

Here, the offset values offset11 to offset14 may have negative values. Also, the offset values offset11 to offset14 may have the same value or have values different from one another. In addition, the absolute value of a fourteenth offset value offset14 may be larger than that of an eleventh offset value offset11.

Meanwhile, in the case of a display device having no driving frequency conversion function, the operation S820 may be omitted.

In this specification, it is described that the display device is an organic light emitting device, but the present disclosure is not limited thereto. In some embodiments, the display device may be a liquid crystal display device.

According to the present disclosure, the magnitude of a margin voltage applied when black data is set is decreased, so that it is possible to solve a problem in that an afterimage remains in image conversion.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims.

What is claimed is:

1. A method for setting black data of a display device including a display unit for displaying an image corresponding to data, the method comprising:

applying data having a test voltage for displaying a test black image to the display unit;

measuring a luminance of the test black image according to the test voltage displayed in the display unit; and when the measured luminance is a reference luminance or less, setting first black data by adding a first margin voltage to, the test voltage;

when the measured luminance exceeds the reference luminance, changing the test voltage;

applying data having a changed test voltage to the display unit and re-measuring a luminance of a changed test black image displayed in the display unit, wherein, if a re-measured luminance is the reference luminance or less, the first black data is set by adding the first margin voltage to the changed test voltage, wherein, if the re-measured luminance exceeds the reference luminance, the changing of the test voltage, the applying of the data having the changed test voltage to the display unit and the re-measuring of the luminance of the changed test black image displayed in the display unit are repeated until the changed test voltage reaches a preset maximum test voltage, wherein if the changed test voltage reaches the preset maximum test voltage, the first black data is set by adding the first margin voltage to the changed test voltage, wherein the reference luminance is 0.005 nit; and wherein the first margin voltage is 0.2 V.

2. The method of claim 1, wherein the first black data is used when the display device is driven at a first driving frequency.

3. The method of claim 2, further comprising setting second black data used when the display device is driven at a second driving frequency higher than the first driving frequency, with reference to the first black data.

4. The method of claim 3, wherein the second black data is set by removing a preset voltage from the first black data.

5. The method of claim 1, further comprising setting black data respectively corresponding to reference luminance points set based on a target luminance of light to be emitted by the display device.

6. A display device comprising:

a display unit configured to display an image, based on data;

a data driver configured to supply the data to the display unit; and a black data setting unit configured to set first black data, based on a luminance of a test black image, the test black image being displayed based on data having a test voltage for displaying the test black image that is supplied to the display unit;

the black data setting unit configured to receive a measured luminance of the test black image according to the test voltage, wherein when the measured luminance exceeds a reference luminance, the black data setting unit is configured to:

change the test voltage;

apply data having a changed test voltage to the display unit, and receive a re-measured luminance of a changed test black image displayed in the display unit, wherein, if the re-measured luminance is the reference luminance or less, the black data setting unit is configured to set the first black data by adding a first margin voltage to the changed test voltage, wherein, if the re-measured luminance exceeds the reference luminance, the black data setting unit is configured to repeat the changing of the test voltage, the applying of the data having the changed test voltage to the display unit, and the receiving of the re-measured luminance of the changed test black image displayed in the display unit until the changed test voltage reaches a preset maximum test voltage, wherein if the changed test voltage reaches the preset maximum test voltage, the first black data is set by adding the first margin voltage to the changed test voltage, wherein the reference luminance is 0.005 nit, and wherein the first margin voltage is 0.2 V.

7. The display device of claim 6, wherein, when the luminance of the test black image is the reference luminance or less, the black data setting unit sets the first black data, based on the test voltage.

8. The display device of claim 7, wherein the display device is configured to be driven at a first driving frequency or is configured to be driven at a second driving frequency higher than the first driving frequency.

9. The display device of claim 8, wherein the first black data is used when the display device is driven at the first driving frequency.

10. The display device of claim 9, wherein the black data setting unit is configured to set second black data used when the display device is driven at the second driving frequency, based on the first black data.

11. The display device of claim 10, wherein the second black data is set by removing a preset voltage from the first black data.

12. The display device of claim 7, wherein the black data setting unit is configured to set black data respectively corresponding to reference luminance points set based on a target luminance of light to be emitted by the display unit.

13. The display device of claim 12, wherein the black data are set by applying preset offset values to the first black data to correspond to the respective reference luminance points.

14. The display device of claim 13, wherein the reference luminance points include a first reference luminance point and a second reference luminance point smaller that the first reference luminance point, wherein black data corresponding to the first reference luminance point is larger than that corresponding to the second reference luminance point.

15. The display device of claim 10, further comprising a gamma voltage generating unit configured to transfer a gamma voltage to the data driver, wherein the gamma voltage generating unit is configured to generate a first gamma voltage corresponding to the first black data.

16. The display device of claim 15, wherein the gamma voltage generating unit is configured to generate a second gamma voltage corresponding to the second black data.

17. A display device comprising:

a display unit configured to display an image, based on data;

a data driver configured to supply the data to the display unit; and a black data setting unit configured to set first black data, based on a luminance of a test image, the test image being displayed based on data having a test voltage for displaying the test black image that is supplied to the display unit, wherein the test voltage is 5.9 V or higher; and the black data setting unit is configured to receive a measured luminance of the test image according to the test voltage, wherein when the measured luminance exceeds a reference luminance, the black data setting unit is configured to:

change the test voltage;

apply data having a changed test voltage to the display unit, receive a re-measured luminance of a changed test image displayed in the display unit, wherein, if the re-measured luminance is the reference luminance or less, the black data setting unit is configured to set the first black data by adding a first margin voltage to the changed test voltage, wherein, if the re-measured luminance exceeds the reference luminance, the black data setting unit is configured to repeat the changing of the test voltage, the applying of the data having the changed test voltage to the display unit, and the receiving of the re-measured luminance of the changed test image displayed in the display unit until the changed test voltage reaches a preset maximum test voltage, wherein if the changed test voltage reaches the preset maximum test voltage, the first black data is set by adding the first margin voltage to the changed test voltage, wherein the reference luminance is 0.005 nit, and wherein the first margin voltage is 0.2 V.

18. The method of claim 1, wherein the test voltage is 5.9 V or higher, and wherein the preset maximum test voltage is 6.3V.

19. The display device of claim 6, wherein the test voltage is 5.9 V or higher, and wherein the preset maximum test voltage is 6.3V.

* * * * *